United States Patent [19]

Hammond

[11] Patent Number: 4,685,248

[45] Date of Patent: Aug. 11, 1987

[54] WINDOW REGULATOR MECHANISM WITH RACK SUPPORTING TRACK OF RECTANGULAR CHANNEL SHAPE

[75] Inventor: Albert J. Hammond, Bloomfield, Mich.

[73] Assignee: Ferro Manufacturing Corporation, Madison Heights, Mich.

[21] Appl. No.: 885,510

[22] Filed: Jul. 14, 1986

[51] Int. Cl.[4] ..... E05F 11/48

[52] U.S. Cl. ..... 49/352; 49/349

[58] Field of Search ..... 49/349, 348, 352, 360, 49/362

[56] References Cited

U.S. PATENT DOCUMENTS 4,168,595 9/1979 Pickles et al. ..... 49/352
4,229,906 10/1980 Pickles ..... 49/352
4,235,117 11/1980 Pickles ..... 49/349 X
4,263,748 4/1981 Kazewych ..... 49/352
4,592,245 6/1986 Pickles ..... 49/352 X

*Primary Examiner*—Philip C. Kannan
*Attorney, Agent, or Firm*—Harness, Dickey & Pierce

[57] ABSTRACT

A window regulator mechanism comprising an elongated track of generally rectangular channel shape and an elongated rack slidably supported and confined in the track. The track is provided on one side with a continuous slot located opposite the rack teeth to enable a drive pinion to extend through the slot into driving engagement with the rack. A separate connector is assembled with one end of the rack and retained in an assembly relation with the rack by the track structure to thereby enable attachment of the rack to the structure that moves the window between raised and lowered positions.

6 Claims, 7 Drawing Figures

WINDOW REGULATOR MECHANISM WITH RACK SUPPORTING TRACK OF RECTANGULAR CHANNEL SHAPE

BACKGROUND OF THE INVENTION

This invention relates generally to a window regulator mechanism and more particularly to a mechanism for raising and lowering a vehicle window in which a longitudinally movable flexible rack is supported in a bendable but operationally rigid track which is of rectangular channel shape in cross section.

It is known to provide a window regulator mechanism for moving a vehicle window between a raised position closing the window opening and a lowered position in which the window is stored in a storage cavity within the vehicle door. It is also known to employ a plastic rack of elongated shape which is bendable and which is confined within an operationally rigid track for moving the window between these positions, as shown in U.S. Pat. Nos. 4,168,595, 4,229,906, and 4,235,117. It is an object of this invention to provide a rack which is improved from the standpoint of ease of manufacture and which is also improved from the standpoint of its being confined within a rectangular channel shape track which enables easy assembly of the rack with connectors that are separate from the rack and are used to connect the rack to the structure which supports the window for up and down movement. This enables construction of the connector from materials different from the flexible material from which the rack is made and also enables use of different connector structures with the same rack.

SUMMARY OF THE INVENTION

This invention provides a window regulator mechanism which includes an elongated track of generally rectangular channel shape having four walls and a continuous slot in one of the walls. An elongated flexible rack is slidably supported and confined in the track so that movement of the rack is limited to movement in a direction longitudinally of the track. The rack has teeth located within the track at a position opposite the slot to enable driving of the rack longitudinally of the track by a driving mechanism extending through the slot. This movement of the rack effects movement of the window between the desired raised and lowered positions by utilizing a connector to connect one end of the rack to the conventional structure that supports the window for up and down movement.

The connectors can take different forms but in all forms comprise a body having a rectangular shape extension corresponding in shape to the rectangular shape of the inside of the track and slidably supported therein for movement with the rack. The body also has an attaching rack section arranged in an end to end relation with the extension and positioned in interlocking tooth-to-tooth engagement with the rack at a position within the track. The track is thus utilized to support the rack and the connector for movement longitudinally of the rack and in addition functions to maintain the connector in a connected position to the rack. A mounting section formed integral with the body and the rack section extends outwardly through the slot and is dimensioned for sliding engagement with the track on opposite sides of the slot. This enables guided movement of the connector lengthwise of the track and enables the connector to be attached to the window support structure at a position outside the track.

The result is a window regulator that can be readily manufactured because the plastic rack can be extruded and the connectors can be manufactured of more rigid material than the rack because they are manufactured separately from the rack. This enables manufacture of the rack from a material which enhances its flexibility and manufacture of the connector from material which enhances its strength.

Further objects, features, and advantages of the invention will become apparent from the following description and the appended claims when taken in connection with the accompanying drawing in which:

Figure 1:
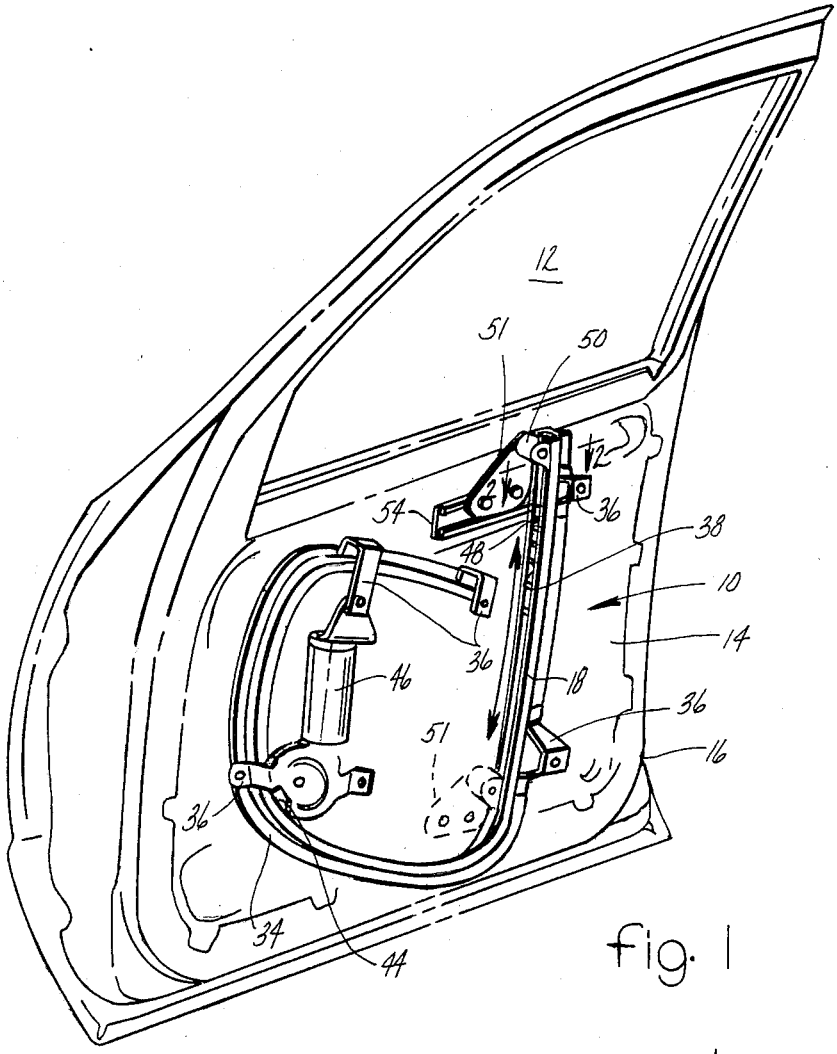
FIG. 1 is a partially broken away side elevational view of a vehicle door with the window regulator mechanism of this invention mounted thereon and showing the window in the raised position.

With reference to the drawing, the window regulator mechanism of this invention, indicated generally at 10, is illustrated in FIG. 1 in assembly relation with a vehicle window 12 and mounted in a window storage cavity 14 in a vehicle door 16. The mechanism 10 is operable to move the window 12 between its upper closed position shown in FIG. 1 and a lower storage position within the cavity 14.

Figure 2:
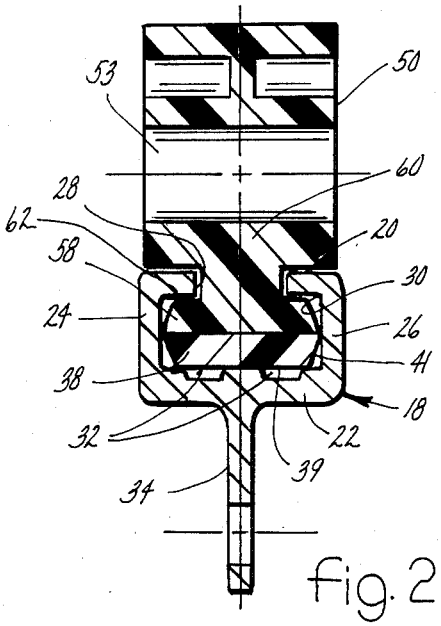
FIG. 2 is an enlarged sectional view of the rack and track assembly in the mechanism of this invention, as seen from substantially the line 2—2 in FIG. 1.

The mechanism 10 includes a track 18 which may be formed of metal or plastic with metal insert and which is bendable into the irregular configuration illustrated in FIG. 1 to adapt it to the shape of the cavity 14. As shown in FIG. 2, the track 18 is of generally rectangular channel-shape, having four sides, namely, two long sides 20 and 22 and two shorter sides 24 and 26. The side 20 is formed with a continuous slot 28 for a purpose to appear presently. The inside surface 30 of the track 18 is also of generally rectangular shape, the side 22 being formed with longitudinally extending grooves 32 to faciliate sliding movement of a part confined within the track 18.

The side 22 is also provided with mounting flange 34 which can take various forms and locations and which facilitates mounting of the track 18 on the vehicle door 16 in the position shown in FIG. 1. Mounting brackets 36 are secured to the track and to the door 16 to mount the track in the illustrated position.

A continuous rack member 38, preferably formed of a suitable plastic material which can be economically manufactured by injection or an extrusion process because the rack 38 is of the same shape throughout its length, is mounted in the track 18. As shown in FIGS. 2–5, inclusive, the rack 38 is of a generally rectangular shape in cross section corresponding to the rectangular shape of the inner surface 30 of the track 18. The rack 38 has a flat surface 39 on one side and is formed with transverse evenly spaced grooves 40 on the other side which cooperate to form outwardly extending teeth 42 that are located in positions opposite and facing the continuous slot 28 in the track 18. The sides 41 of the rack 38 are straight and extend between the surface 39 and the teeth 42.

A drive pinion 44, suitably mounted on some of the brackets 36 and driven by a motor 46 (or by manual means) in the cavity 14, projects through the slot 28 into driving relation with the rack teeth 42 for moving the rack 38 back and forth in a direction lengthwise of the track 18 for the purpose of raising and lowering the window 12. On the side of the pinion 44 where the rack member 38 is only stored, namely, the top side in the assembly shown in FIG. 1, the slot 28 can be of rectangular tube shape.

As shown in FIG. 1, a terminal end portion 48 of the rack 38 is assembled with a connector 50 which is in turn connected through a bracket 51 and a support member 54 to the lower end of the window 12 for moving the bracket 51 between the solid and broken line positions shown in FIG. 1 to raise and lower the window 12. In the mechanism 10 of this invention, the connector 50 is manufactured separately from the rack 38 to enable manufacture of the connector 50 from a durable rigid material while still permitting manufacture of the rack 38 from a flexible material so that the rack 38 can be conformed to the irregular shape of the track 18.

Figure 5:
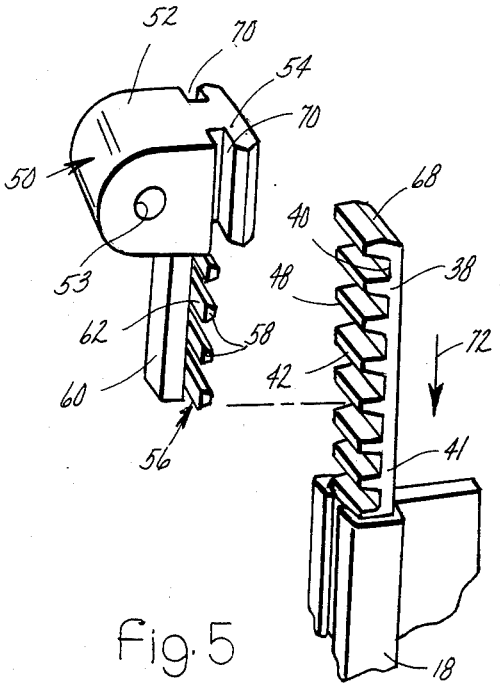
FIG. 5 is an exploded perspective view of the assembly shown in FIG. 2.
Figure 6:
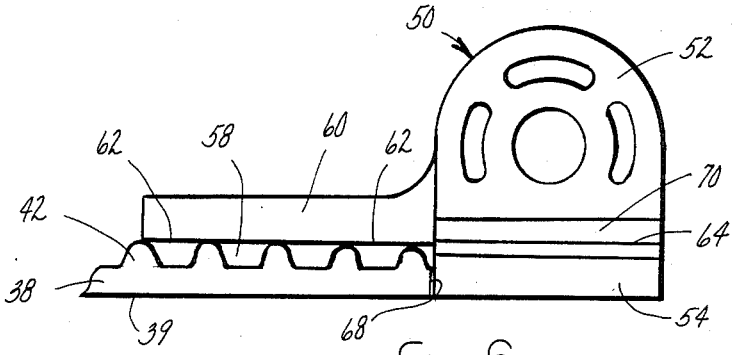
FIG. 6 is a side elevational view of the connector in the assembly shown in FIG. 2.

As shown in FIG. 5, the connector 50 consists of a body 52 of rounded block form having an attachment opening 53 and a rectangular extension 54 which extends generally lengthwise of the rack 38. The extension corresponds in cross sectional shape to the general rectangular shape of the rack 38 so that the extension 54 can slide lengthwise of the track 18 at a position engaged with the inner surface 30 thereof. The body 52 is also integrally formed with a rack section 56 having teeth 58 that will fit in the grooves 40 and mesh with the rack teeth 42. A mounting portion 60 is also formed integral with the body 50 and extends longitudinally of the rack section 56 and the rectangular extension 54. As shown in FIG. 6, the mounting portion 60 is integral with the outer sides 62 of the teeth 58. As also appears in FIG. 6, the outer sides 62 of the teeth 58 are generally coplanar with each other and with the outer side 64 of the rectangular extension 54. These sides 62 and 64 slidably engage the inner surface of the side wall 20 of the track 18 during movement of the rack 38 in the track 18. The mounting portion 60 and a reduced thickness portion 66 which mounts the body 52 to the extension 54 are of a size to extend through the slot 28 for slidable engagement with the track side wall 20 on opposite sides of the side wall 28.

In the assembly of the connector 50 with the rack 38, the teeth 58 are moved into meshing engagement with the rack teeth 42 with the extension 54 on the body 52 adjacent the end 68 of the rack 38 as shown in FIG. 6. The rack 38 and the extension 54 are then moved endwise into the open end of the track 18, as shown by arrow 72 in FIG. 5, until they are retained in operative relation by the side wall 20 of the track 28 which clamps the rack section 56 against the rack 38. During movement of the extension 54 into the track 18, the track side wall 20 on opposite sides of the slot 28 extends into slots 70 formed in the connector 50 between the body 52 and the extension 54.

Figure 3:
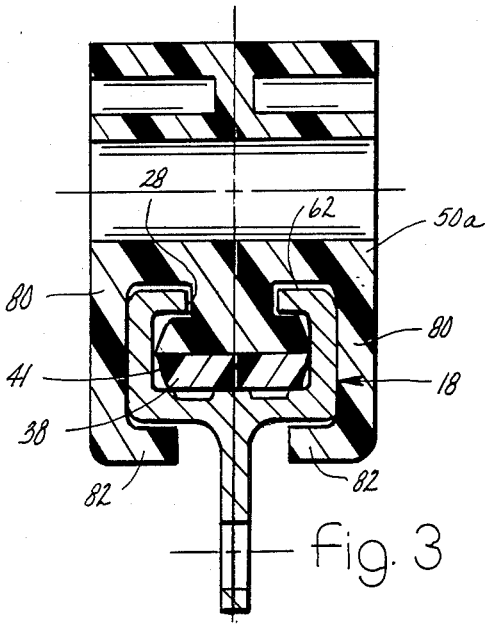
FIG. 3 is a sectional view like FIG. 2 showing a modified form of the connector in the rack and track assembly.
Figure 4:
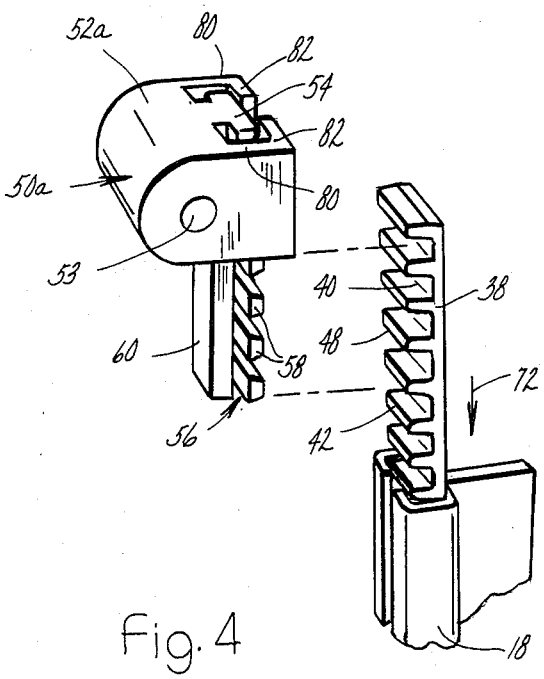
FIG. 4 is an exploded perspective view of the assembly shown in FIG. 3.
Figure 7:
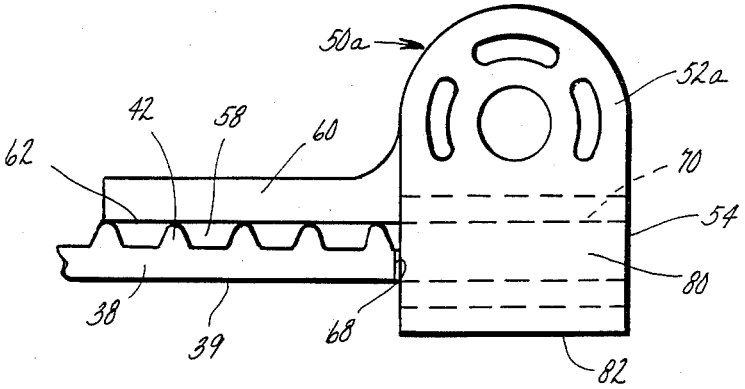
FIG. 7 is a side elevational view of the connector in the assembly shown in FIG. 3.

A modified form of connector 50, indicated at **50*a*, is illustrated in FIGS. 1, 3 and 7. The connector 50*a* is similar in all respects to the connector 50 except for the provision of side walls 80 on the body 52*a* which extend along the track walls 24 and 26 and terminate at their lower ends in inwardly directed flanges 82 which engage the track wall 22. In all other respects, the connector 50*a* is similar to the connector 50 and for that reason, like numerals are used on the connector 50*a* to indicate parts thereof that are like the similarly numbered parts on the connector 50**.

From the above description, it is seen that this invention provides a window regulator mechanism 10 which is improved by virtue of the construction and cooperative relationship of the rack 38 and the track 18. This relationship enables the separate construction of the rack 38 and the connectors 50 and **50*a* and provides for ease of assembly of a connector 50 or 50*a* with one end of the rack 38. This provides for an improved mechanism 10 because it enables construction of the rack 38 from a plastic material having desired flexibility characteristics and the assembly of the rack 38 with the track 18 insures the structural reinforcement of the rack 38 by the track 18** which is conveniently formed of a strong metal or plastic with metal insert material.

The connectors 50 and **50*a* can be formed of a material different from the material from which the rack 38 is formed thereby more adequately adapting the connector 50 or 50*a* for enduring the loading to which the connector 50 or 50*a* is uniquely exposed during operation of the mechanism 10. The result is a mechanism 10** which will operate efficiently over a prolonged service life.

What is claimed is:

1. In a vehicle body door having a window opening and a window storage cavity beneath the window opening, a window movable between a raised position closing the opening and a lowered position stored in the storage cavity, and a window regulator mechanism connected to the window for moving the window along a path of movement between the raised and lowered positions, said regulator mechanism including an elongated hollow track having an inside surface of generally rectangular shape having four walls and a continuous slot in one of said walls, an elongated rack slidably supported on said inside surface and confined in said inside surface, said rack having teeth located within said inside surface at a position opposite said slot to enable driving of said rack longitudinally of said track to effect said movement of said window between said raised and lowered positions, said rack being generally rectangular in shape corresponding substantially to the rectangular shape of said inside surface so that movement of said rack relative to said track is limited to movement lengthwise of said track.

2. In a vehicle body door having a window opening and a window storage cavity beneath the window opening, a window movable between a raised position closing the opening and a lowered position stored in the storage cavity, and a window regulator mechanism connected to the window for moving the window along a path of movement between the raised and lowered positions, said regulator mechanism including an elongated track of generally rectangular channel shape having four walls and a continuous slot in one of said walls, an elongated rack slidably supported and confined in said track, said rack having teeth located within said track at a position opposite said slot to enable driving of said rack longitudinally of said track to effect said movement of said window between said raised and lowered positions, said rack being generally rectangular in shape corresponding substantially to the rectangular shape of the inside of said track so that movement of said rack relative to said track is limited to movement lengthwise of said track, a connector member attached to one end of said rack for applying force to said window, said member comprising a body having a rectangular shape extension corresponding in shape to the rectangular shape of the inside of said track and slidably supported therein, said body also having an attaching rack section arranged in an end-to-end relation with said extension and positioned in interlocking tooth-to-tooth engagement with said rack, and a mounting section formed integral with said body and said rack section, said mounting section extending outwardly through said slot and being dimensioned for sliding engagment with said track on opposite sides of said slot.

3. The mechanism according to claim 2 wherein said rack section includes a plurality of teeth the outer sides of which are co-planar and slidingly engaged with the inside surface of said one wall of said track on opposite sides of said slot.

4. The mechanism according to claim 3 wherein said body extension has a top surface that is substantially co-planar with the outer sides of the teeth on said rack section.

5. The mechanism according to claim 2 wherein said body further includes portions positioned opposite the other walls of said track member in addition to said wall which contains said slot.

6. The mechanism according to claim 2 further including a toothed rotatable drive member extended through said slot and drivingly engaged with said rack teeth.

* * * * *